US008826692B2

(12) United States Patent
Alekseev

(10) Patent No.: US 8,826,692 B2
(45) Date of Patent: Sep. 9, 2014

(54) METHOD AND DEVICE FOR LOW-TEMPERATURE AIR SEPARATION

(75) Inventor: Alexander Alekseev, Wolfratshausen (DE)

(73) Assignee: Linde Aktiengesellschaft, Munich (DE)

( * ) Notice: Subject to any disclaimer, the term of this patent is extended or adjusted under 35 U.S.C. 154(b) by 871 days.

(21) Appl. No.: 12/864,249

(22) PCT Filed: Jan. 23, 2009

(86) PCT No.: PCT/EP2009/000431
§ 371 (c)(1),
(2), (4) Date: Oct. 25, 2010

(87) PCT Pub. No.: WO2009/095188

PCT Pub. Date: Aug. 6, 2009

(65) Prior Publication Data

US 2011/0023540 A1 Feb. 3, 2011

(30) Foreign Application Priority Data

Jan. 28, 2008 (DE) ..... 10 2008 006 431
Jun. 19, 2008 (EP) ..... 08009400

(51) Int. Cl.
*F25J 3/00* (2006.01)
*F25J 3/04* (2006.01)

(52) U.S. Cl.
CPC ..... *F25J 3/04442* (2013.01); *F25J 3/04393* (2013.01); *F25J 3/04084* (2013.01); *F25J 3/04175* (2013.01); *F25J 3/04872* (2013.01); *F25J 3/04296* (2013.01); *F25J 3/04878* (2013.01); *F25J 3/04303* (2013.01); *F25J 2240/40* (2013.01); *F25J 2205/04* (2013.01); *F25J 3/04709* (2013.01); *F25J 3/0409* (2013.01)
USPC ..... 62/643; 62/646

(58) Field of Classification Search
USPC ..... 62/644, 646, 643, 645
See application file for complete search history.

(56) References Cited

U.S. PATENT DOCUMENTS 5,730,004 A * 3/1998 Voit ..... 62/646
2002/0189281 A1* 12/2002 Pompl ..... 62/646
2006/0075779 A1 4/2006 Higginbotham

FOREIGN PATENT DOCUMENTS

DE 11 45 649 B 3/1963
DE 199 33 558 A1 9/2000
FR 2 831 250 A 4/2003
WO WO 0060294 A 10/2000

OTHER PUBLICATIONS

English Abstract of FR 2 831 250.

(Continued)

*Primary Examiner* — Frantz Jules
*Assistant Examiner* — Webeshet Mengesha
(74) *Attorney, Agent, or Firm* — Cahn & Samuels, LLP

(57) ABSTRACT

The invention relates to a method and a device used for the low-temperature separation of air in a distillation column system, comprising at least one high-pressure column (11) and a low-pressure column (12). The method has a high pre-liquifaction of 30% or more. Feed air is introduced into the distillation column system. The distillation column system further has a pre-column (10), the operating pressure of which is higher than the operating pressure of the high-pressure column (11). A first partial stream (1) of the feed air is introduced into the pre-column (10). The pre-column (10) has a head condenser (14), which is configured as a condenser-evaporator having a condensation chamber and an evaporation chamber. A gaseous fraction (30, 31) from the upper region of the pre-column (10) is introduced into the condensation chamber of the head condenser (14). Fluid (6) formed in the condensation chamber is at least partially applied to the pre-column (10) as runback (7). A second partial stream (2*a;* 2*b*) of the feed air is introduced into the evaporation chamber of the head condenser (14).

18 Claims, 6 Drawing Sheets

(56) References Cited

OTHER PUBLICATIONS

English Abstract of WO 0060294.
English Abstract of DE 199 33 558.
Response to International Search Report and First Written Opinion by the International Search Authority, International application No. PCT/EP2009/000431, dated Jun. 2, 2010.

* cited by examiner

METHOD AND DEVICE FOR LOW-TEMPERATURE AIR SEPARATION

This U.S. patent application is a national stage application of PCT/EP2009/000431 filed on 23 Jan. 2009 and claims priority of both European patent document 08009400.6 filed on 19 Jun. 2008 and German patent document 10 2008 006 431.9 filed on 28 Jan. 2008, the entireties of which are incorporated herein by reference.

FIELD OF INVENTION

The invention relates to a method for low-temperature separation of air.

BACKGROUND OF THE INVENTION

Methods and devices for low-temperature separation of air are known, for example, from Hausen/Linde, Tieftemperaturtechnik [Low-temperature technology], 2nd edition 1985, Chapter 4 (pages 281 to 337).

The distillation column system of the invention comprises a two-column system (for example a classical Linde double-column system) for separating nitrogen/oxygen having a high-pressure column and a low-pressure column which are in a heat-exchange relationship with one another. The heat-exchange relationship between high-pressure column and low-pressure column is generally effected by a main condenser in which overhead gas of the high-pressure column is liquefied against vaporizing bottom liquid of the low-pressure column. In addition to the columns for separating nitrogen/oxygen, the distillation column system can comprise other devices, for example for producing other air components, in particular noble gases, for example an argon production stage which comprises at least one crude argon column, or a krypton-xenon production stage. The distillation column system, in addition to the distillation columns, also comprises the heat exchangers directly assigned thereto, which heat exchangers are generally constructed as condenser-evaporators.

The majority of modern air separation plants are constructed on the basis of what is termed a double column. This system of two coupled columns having differing working pressures enables not only the production of gaseous oxygen-, argon- and nitrogen-containing products, but also liquid fractions. These liquids can be taken off from the air separation plant as liquid end products or are internally compressed (brought to the higher pressure in a pump and warmed), so they are then available as gaseous pressurized products.

If such liquid fractions are taken off from the double-column system, a corresponding amount of air must be preliquefied before being fed into the double column, that is to say some of the air is passed into the double-column system in the gaseous state (feed air to the high-pressure column and, e.g., air from the Lachmann turbine, which is fed directly into the low-pressure column) and some of the air is fed into the double-column system in the liquid state (throttling stream and liquid air from Claude turbine, where present). If many products are taken off in the liquid state, the proportion of preliquefied air increases correspondingly.

Since only the lower sections of both columns are charged with liquid air, the preliquefied air shares only few of the rectification processes in the double column (compared with gaseous air). Therefore, the preliquefaction has an adverse effect on the rectification processes in the double column. With increasing air preliquefaction, the oxygen yield decreases (and also the argon yield, if the system produces argon). The efficiency and economic efficiency of the air separation plant decrease.

In order to intensify the rectification (in particular in the upper sections of both columns), resort is made to measures such as what is termed a "feed compressor" (which compresses some of the product from the upper part of the low-pressure column to the pressure of the high-pressure column and this is fed into the high-pressure column) and/or attempts are made to use what is termed a nitrogen cycle for generating cold (the air in this case is not liquefied upstream of the double column but within the pressure column by liquid nitrogen). These measures, however, mean a higher energy consumption and make the overall plant more expensive as a result of a higher number of heat exchangers and/or machinery.

SUMMARY OF THE INVENTION

It is an object of the invention to increase the oxygen yield (and argon yield, if argon is produced) of an air separation plant even in the case of a high preliquefaction (for example greater than 30 mol %, in particular greater than 40 mol %, of the total feed air) without using additional machinery and heat exchangers.

This object is achieved by the features of patent claim 1. In this case an additional third column ("precolumn") is connected upstream of the conventional double column. At least some of the gaseous air (the "first substream") is firstly passed into this third column and (similarly to in the high-pressure column of the double column) separated into liquid nitrogen fractions and crude oxygen. This upstream column is cooled by preliquefied air (the "second substream") by means of a top condenser (generally placed above the column). This liquid is vaporized in this process and fed in the gaseous state into the distillation column system, preferably into the high-pressure column.

The third column is operated at a pressure which is higher than the pressure of the high-pressure column of the double column in order that the air which vaporizes in the top condenser can be introduced into the high-pressure column.

Preferably, the pressure ratio between precolumn and high-pressure column (in each case measured at the top) is at least 1.4 and is in particular between 1.4 and 1.8, preferably between 1.5 and 1.7.

Liquid nitrogen from the precolumn (or from the condensation compartment of the top condenser thereof) is then fed into the high-pressure column, liquid crude oxygen from the lower region of the precolumn into the high-pressure column and/or into the low-pressure column, or alternatively or additionally into the argon part, where present.

By means of these connections the following advantages are achieved:

- The preliquefied air is vaporized in the top condenser of the precolumn and passed in the gaseous state into the double column. In this manner the adverse effect of the preliquefaction is markedly reduced.
- The rectification in the double column can be improved by feeding in one or more wash-LIN fraction(s) from the precolumn or top condenser thereof.
- The oxygen yield increases markedly and so customary yields can be achieved even in the case of preliquefaction of greater than 50%. The same applies to the argon yield if the plant additionally generates argon.
- The dimensions of columns, especially the high-pressure column and the precolumn, are relatively small.
- From the precolumn, pressurized nitrogen (VHPGAN—very high pressure gaseous nitrogen) can be obtained at a pressure which is higher than the pressure of the high-pressure column of the double column.

For generation of cold, the air can be expanded in a turbine not only to the pressure of the low-pressure column (Lachmann turbine) or pressure of the high-pressure column (HPC Claude turbine), but also to the pressure of the precolumn or top condenser thereof (PC Claude turbine).

According to a fundamental concept of the invention, as far as possible all process streams available at high pressure which are suitable for cooling the precolumn are used for cooling thereof (this does not exclude, however, that in individual cases some of these process streams are introduced into the distillation column system at another point). In particular, preferably the entire preliquefied air, in any case more than 80 mol %, or more than 90 mol % of the preliquefied air, is introduced into the vaporization compartment of the top condenser of the precolumn.

The invention additionally relates to a device for low-temperature air separation according to patent claim 12.

The following variants are possible in the scope of the invention and can if appropriate also be combined with one another:

1. Precolumn by the side of the double column (high-pressure column and low-pressure column one above the other).
2. All three columns side by side.
3. Three columns with PC Claude turbine, the gaseous air expanded into the precolumn and liquid air expanded into the top condenser of the precolumn.
4. Use in methods having compression of all of the air to markedly above precolumn pressure; in this case, regularly a part is liquefied in the context of what is termed internal compression or (at supercritical pressure) pseudoliquefied and subsequently throttle-expanded; the remainder is work-producingly expanded in one or more turbines, in particular to the pressure of the precolumn or top condenser thereof.
5. Three columns having an HPC Claude turbine which expands air into the high-pressure column.
6. Three columns having a Lachmann turbine which expands air into the low-pressure column.
7. Three columns in combination with two turbines (PC Claude turbine with HPC Claude turbine, PC Claude turbine with Lachmann turbine, HPC Claude turbine with Lachmann turbine).
8. Three columns with three turbines (PC Claude turbine, HPC Claude turbine and Lachmann turbine).
9. With or without argon production.
10. The heat exchangers can be split or integrated.

The invention and also further details of the invention will be explained in more detail hereinafter with reference to exemplary embodiments shown in the drawings. In this case, in the drawings:

DETAILED DESCRIPTION OF INVENTION

Figure 1:
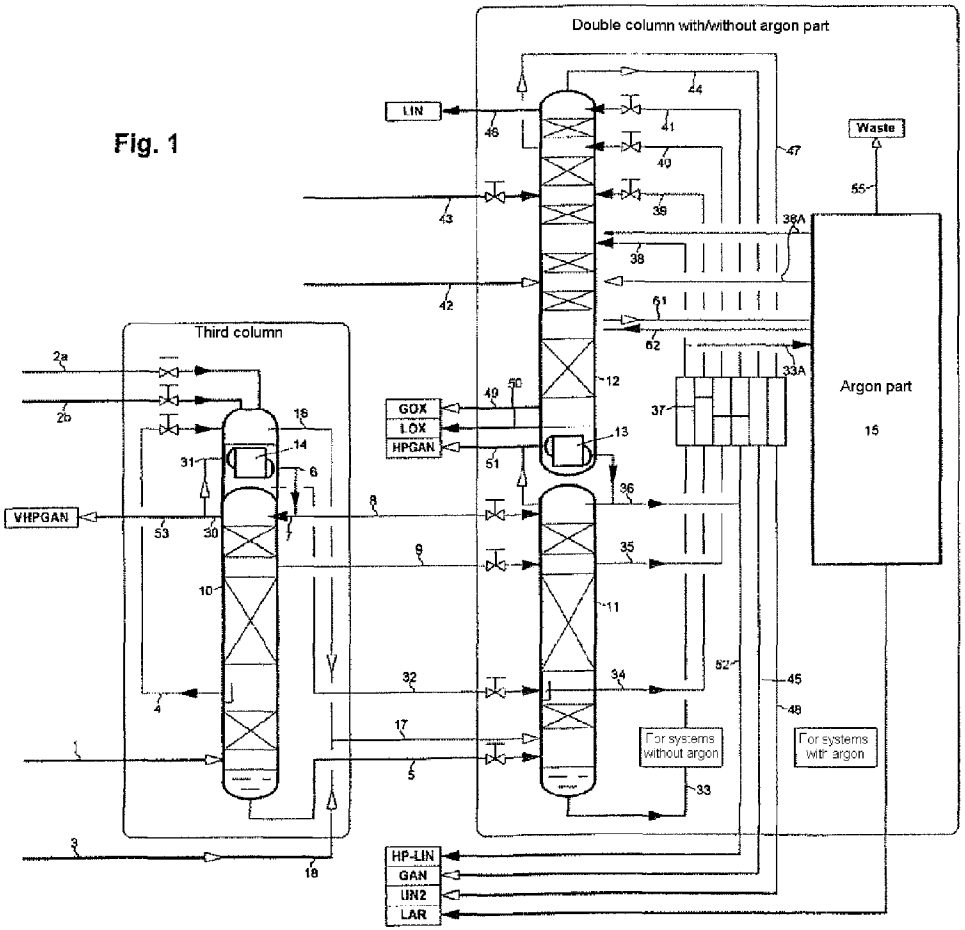
FIG. 1 shows a first exemplary embodiment of the method according to the invention.

In FIG. 1, the compression, purification and cooling of the feed air is not shown. The distillation column system comprises here a precolumn 10, a high-pressure column 11 and a low-pressure column 12, and also the condenser-evaporator linked thereto, the main condenser 13 and the top condenser 14 of the precolumn. Optionally, the distillation column system can additionally comprise an argon part 15 which contains, in particular, at least one crude argon column and top condenser thereof; in addition, the argon part can comprise a pure argon column for argon/nitrogen separation.

The separation columns for nitrogen/oxygen separation in the example have the following operating pressures (in each case at the top):

| | |
|---|---|
| precolumn 10 | 7.5 to 12 bar, |
| high-pressure column 11 | 5.0 to 6.5 bar, |
| low-pressure column 12 | 1.3 to 1.6 bar. |

A first substream 1 of the feed air comes in the gaseous state from the cold end of the main heat exchanger (which is not shown) or from a turbine. It is at a pressure which is just above the operating pressure of the precolumn 13 and is introduced immediately above the bottom.

The precolumn 10 comprises a top condenser 14, into the evaporation compartment of which a second substream of air in the liquid state is introduced. This "second substream" is formed in the example by two subdivided streams 2*a*, 2*b*. Subdivided stream 2*a* originates from the outlet of a PC Claude turbine, subdivided stream 2*b* originates from the cold end of the main heat exchanger (which is not shown) and was condensed or (at supercritical pressure) pseudocondensed against a taken off from the distillation column system in the liquid state and subsequently brought to pressure in the liquid state. During the introduction into the evaporation compartment of the top condenser 14, the second substream 2*a*, 2*b* consists essentially (85 to 95 mol %) of liquid. The liquid fraction thereof comprises 30 to 50 mol % of the total feed air. The remaining feed air is introduced into the distillation column system in the gaseous state. The gaseous introduction proceeds—except for possible gaseous fractions in the streams 2*a* and 2*b* and the turbine stream 3—completely via the first substream 1 into the interior of the precolumn 10.

In the example, furthermore, an additional liquid stream 4 is passed into the vaporization compartment of the top condenser 14. This originates from an intermediate point of the precolumn 10 which is arranged about 8 to 16 theoretical or practical plates above the bottom.

The entire bottom liquid 5 of the precolumn is introduced here into the high-pressure column 11, more precisely immediately at the bottom thereof. Alternatively, or additionally, the bottom liquid 5 of the precolumn or a part thereof—after cooling in the subcooling countercurrent heat exchanger 37, can be fed into the low-pressure column 12 and/or the argon part 15 (which is not shown in the drawing). The liquid 6 generated in the condensation compartment of top condenser 14 from a part 31 of the top nitrogen 30 of the precolumn 10 is fed into the precolumn 10 as a first part as top reflux 7 and as a second part 8 to the top of the high-pressure column 11.

Furthermore, a nitrogen-enriched impure fraction 9 can be passed from the precolumn into the high-pressure column; this impure fraction 9 is taken off at an intermediate point of the precolumn 10 which is arranged about 8 to 16 theoretical or practical plates below the top and passed to the high-pressure column 11 at an intermediate point.

The vaporized fraction 16 formed in the evaporation compartment of the top condenser is passed via line 17 to the bottom of the high-pressure column, together with a third substream 18 of the feed air which originates from the outlet of an HPC Claude turbine. The purge liquid 32 from the top condenser 14 of the precolumn 10 is fed to the high-pressure column 10 at an intermediate point in the lower region.

In the example, furthermore, a further liquid stream 4 is passed into the evaporation compartment of the top condenser 14. This further liquid stream originates from an intermediate point of the precolumn 10 which is arranged about 8 to 16 theoretical or practical plates above the bottom.

Otherwise, the double column 11/12/13 and the optional argon part 15 function in the generally known manner.

From the high-pressure column 11, liquid crude oxygen 33 at the bottom, a liquid air fraction 34 at the intermediate point at which the purge liquid 32 is introduced, impure nitrogen 35 from an intermediate point situated further above and liquid pure oxygen from the condensation compartment of the main condenser 13 are cooled in a subcooling countercurrent heat exchanger 37 in indirect heat exchange with backflows and introduced into the low-pressure column 12 via the lines 38, 39, 40 or 41 at the suitable points. Furthermore, gaseous air 42 from a Lachmann turbine and/or liquid air 43 from an HPC Claude turbine can be fed into the low-pressure column 12.

If the plant does not have an argon part, the following products can be withdrawn:

- gaseous nitrogen (GAN) 44, 45 from the top of the low-pressure column 12
- liquid nitrogen (LIN) 46 from the top of the low-pressure column 12
- gaseous impure nitrogen (UN2) 47, 48 from an intermediate point in the upper region of the low-pressure column 12
- gaseous oxygen (GOX) 49 directly above the bottom of the low-pressure column 12
- liquid oxygen (LOX) 50 from the bottom of the low-pressure column 12
- gaseous pressurized nitrogen (HPGAN) 51 from the top of the high-pressure column 11
- liquid pressurized nitrogen (HP-LIN) 52 from the condensation compartment of the main condenser 13 or from the high-pressure column 11
- gaseous nitrogen of particularly high pressure (VHPGAN) 53 from the top of the precolumn 10

The plant can, but need not, generate all of these products simultaneously.

The gaseous product streams are warmed in a main heat exchanger which is not shown in indirect heat exchange with feed air. The main heat exchanger can consist of a block or of two or more parallel and/or serially connected blocks. The liquid oxygen can be produced as a liquid product; alternatively, or additionally, at least a part of the oxygen withdrawn in the liquid state from the low-pressure column is brought to pressure in the liquid state and subsequently vaporized or (at supercritical pressure) pseudo-vaporized in the main heat exchanger and warmed and subsequently withdrawn as gaseous pressurized product (what is termed internal compression).

In a variant of the exemplary embodiment of FIG. 1, the system comprises an argon part 15 for producing liquid pure argon (LAR) 54. The argon part contains one or more crude argon columns for argon/oxygen separation and a pure argon column for argon/nitrogen separation which are operated in the generally known manner. The lower end of the crude argon column communicates via lines 61 and 62 with an intermediate region of the low-pressure column 12. The liquid crude oxygen from the high-pressure column 11 is passed in this case via the line 33A into the argon part and, in particular at least in part of the top condenser of the crude argon column(s), at least in part vaporized (which is not shown). The at least in part gaseous crude oxygen is fed via line 38A into the low-pressure column 12. From the argon part 15, in addition, a gaseous residual stream (waste) 55 is withdrawn.

From the exemplary embodiment of FIG. 1, the following variants deviating from the drawing can be derived:

- The line 4 can be omitted or remain out of operation. The top condenser 14 is then cooled exclusively by liquefied air 2*a*, 2*b*.
- The bottom liquid 5 of the precolumn 10 can be introduced in part or completely after subcooling in 37 into the low-pressure column 12 instead of into the high-pressure column 11. If argon is produced, a part or the entire subcooled liquid can be used before introduction thereof into the low-pressure column for cooling the top condenser of the crude argon column.

Figure 2:
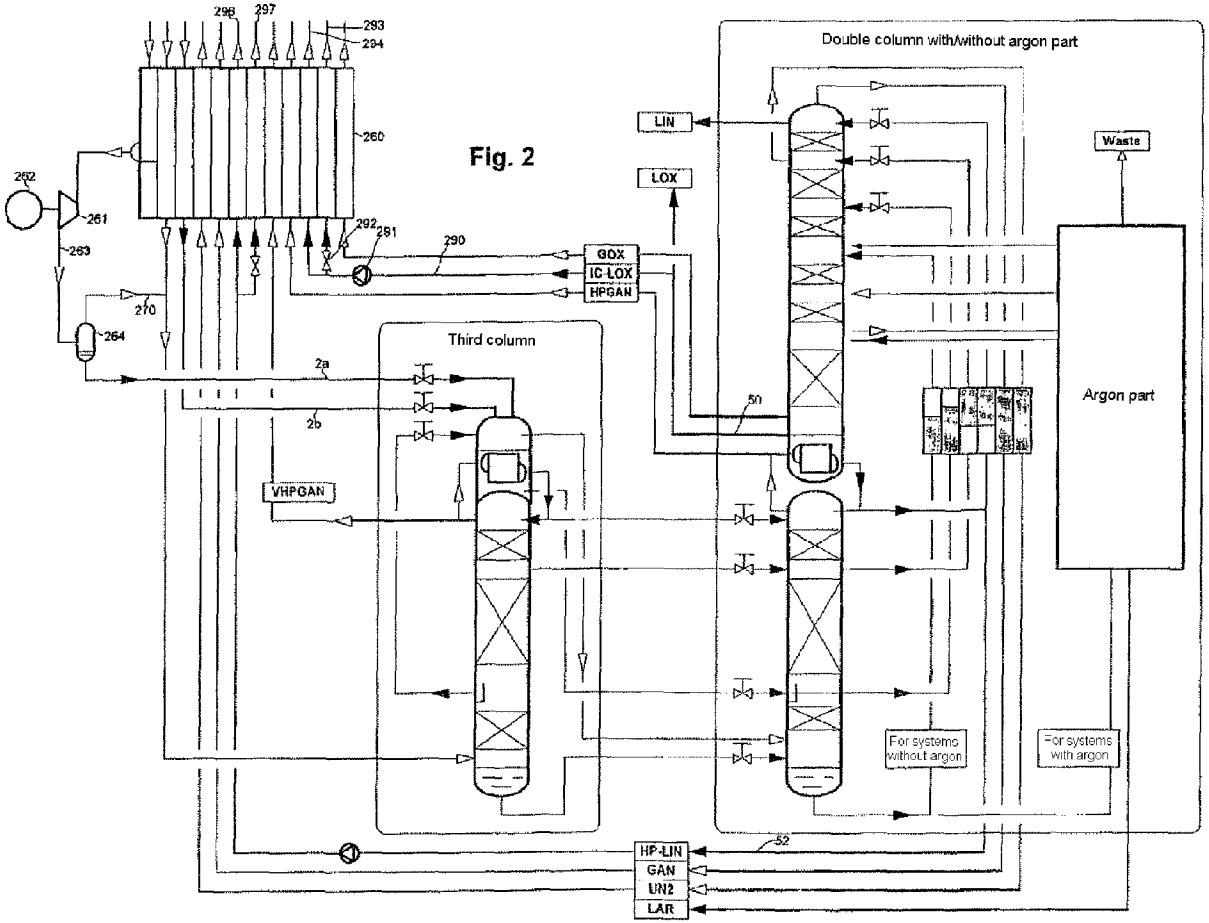
FIG. 2 shows a second exemplary embodiment with a depiction of the main heat exchanger and a PC Claude turbine as single expansion machine.

FIG. 2 shows a drawing with a depiction of the main heat exchanger 260 and a PC Claude turbine 261 as sole expansion machine. The turbine can be braked either by means of an oil brake 262 or by means of a generator or by means of a recompressor which compresses either the turbine stream or throttle stream 2*b* (upstream of the [pseudo]liquefaction thereof in the main heat exchanger 260). The turbine-expanded and at least in part liquefied air 263 is introduced into a phase separation unit 264. The liquid fraction 264 is introduced into the evaporation compartment of the top condenser 14 of the precolumn 10. The gaseous fraction 270 is combined with the gaseous air from the main heat exchanger 260 and fed into the precolumn 10 via line 1.

In FIG. 2, the production of gaseous pressurized oxygen 293, 294 by internal compression is also shown. Here, at least a part (IC-LOX) of the liquid oxygen 50 is fed from the bottom of the low-pressure column 12 via line 290 to an oxygen pump 291, there brought to an elevated pressure and at least a first part vaporized or pseudo-vaporized at this elevated pressure in the main heat exchanger 260 and withdrawn as high-pressure product 294. Another part can be reduced in pressure (292) and at this reduced pressure vaporized or pseudo-vaporized in the main heat exchanger 260 and finally be withdrawn as medium-pressure product 293.

Additionally or alternatively, one or two nitrogen products 296, 297 can be produced at very high pressure in a similar manner by internal compression by bringing the liquid high-pressure nitrogen 52 in a nitrogen pump 295 to a correspondingly high pressure and, at this pressure (and if appropriate in part at a somewhat lower intermediate pressure), (pseudo-) vaporizing and warming it in the main heat exchanger 260.

Figure 3:
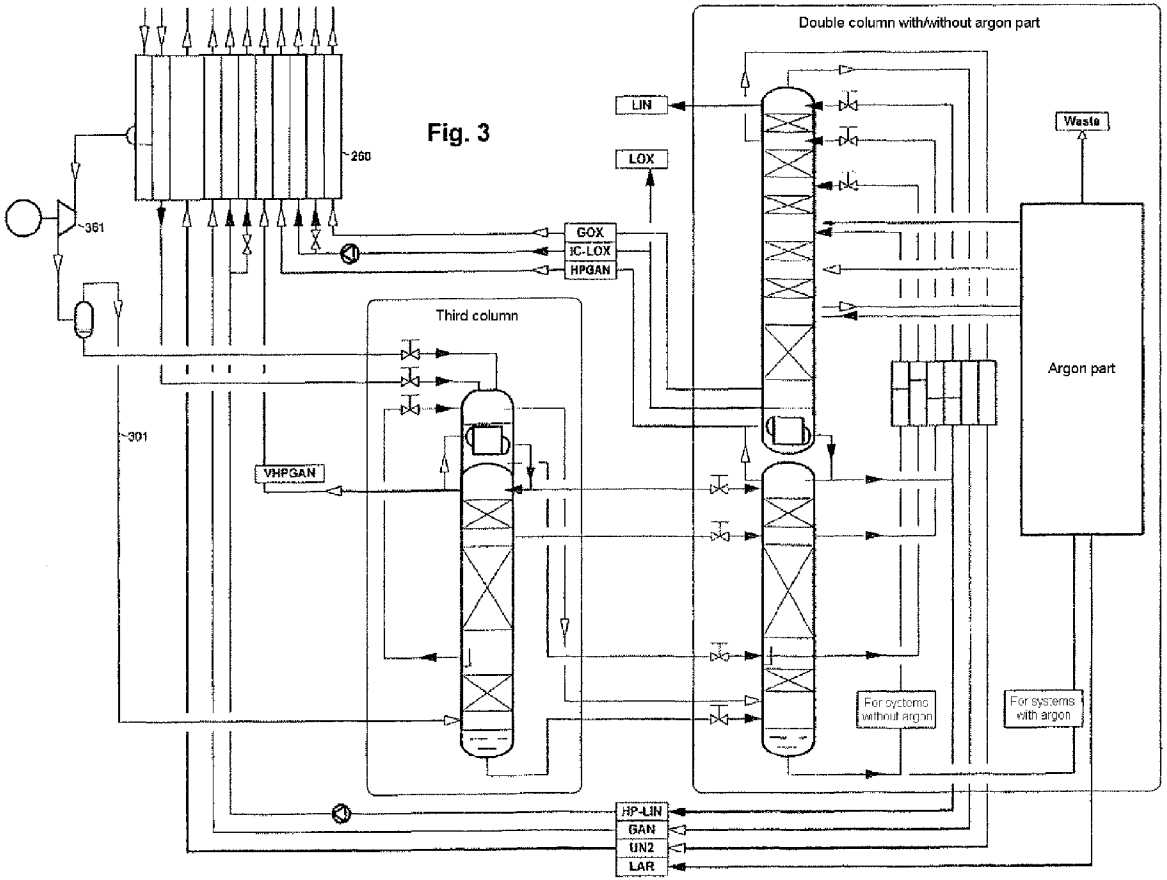
FIG. 3 shows a modification of FIG. 2 in which the entire gaseous feed air (first substream) originates from the PC Claude turbine.

The exemplary embodiment of FIG. 3 differs from FIG. 2 in that the total gaseous feed air (the "first substream") 301 originates from the PC Claude turbine 361.

Figure 4:
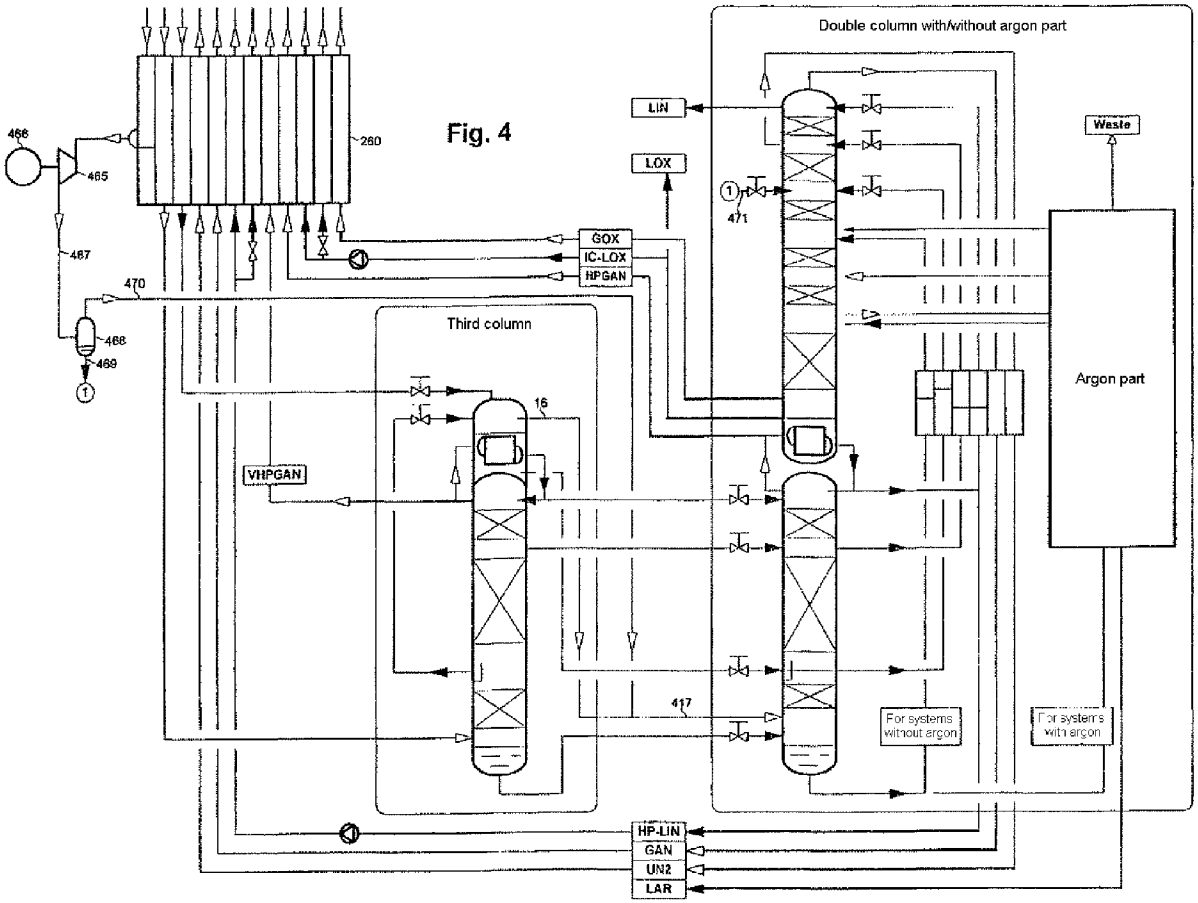
FIG. 4 shows a fourth exemplary embodiment with an HPC Claude turbine as sole expansion machine.

FIG. 4 shows a fourth exemplary embodiment having an HPC Claude turbine 465 as sole expansion machine. The turbine can be braked either by means of an oil brake 466 or by means of a generator or by means of a recompressor which compresses either the turbine stream or throttle stream (upstream of the [pseudo]liquefaction thereof in the main heat exchanger 260). The turbine-expanded and at least in part liquefied air 467 is introduced into a phase separation unit 468. The liquid fraction 469 is passed via line 471 into the low-pressure column 12. The gaseous fraction 470 is combined with the gaseous air 16 from the top condenser of the precolumn 10 and fed into the high-pressure column 11 via line 417.

Figure 5:
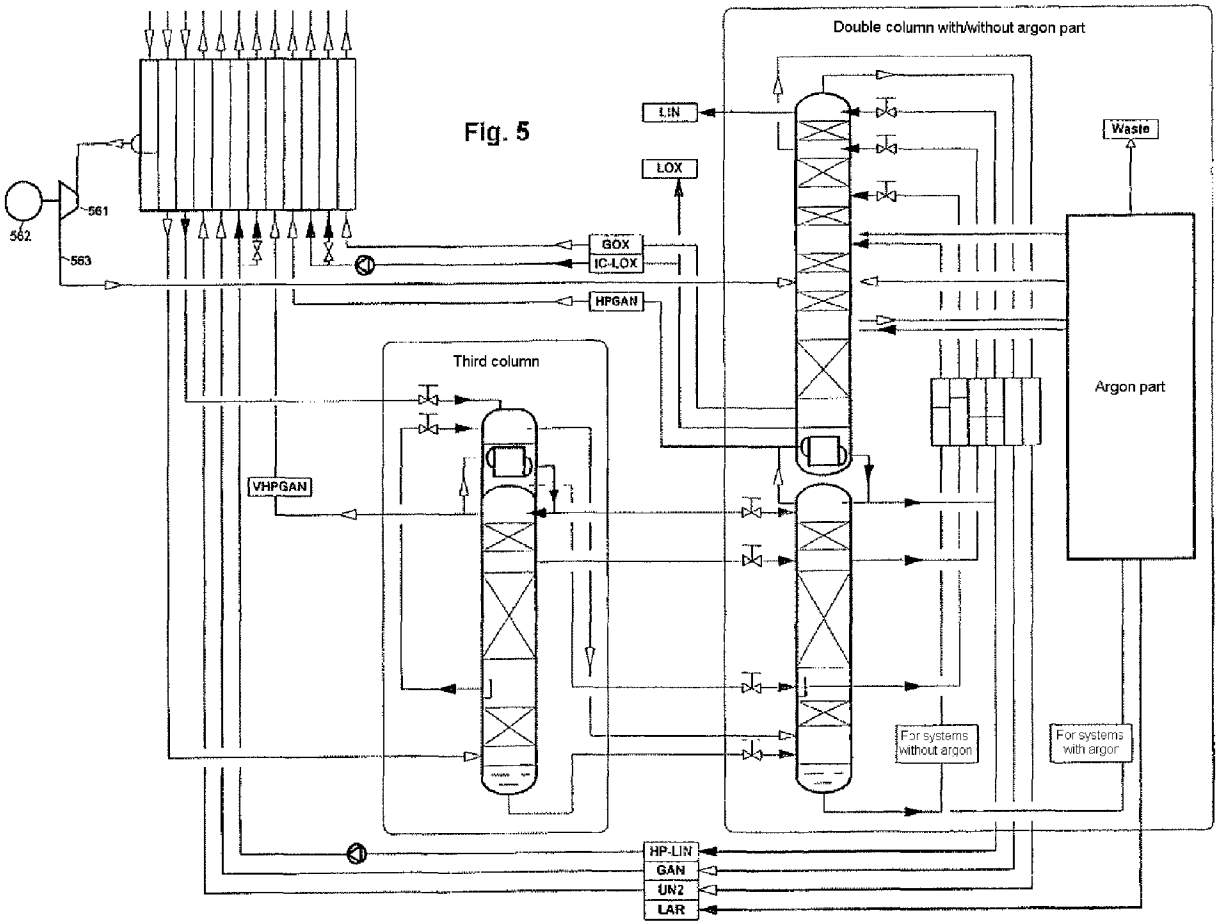
FIG. 5 shows a fifth exemplary embodiment with a Lachmann turbine as sole expansion machine and FIG. 6 shows a fifth exemplary embodiment for production of impure oxygen with compression of the entire air to markedly above precolumn pressure.

In the exemplary embodiment of FIG. 5, a Lachmann turbine is the sole expansion machine. The turbine can be braked either by means of an oil brake 562 or by means of a generator or by means of a recompressor which compresses the turbine stream (upstream of its [pseudo]liquefaction in the main heat exchanger 260). The turbine-expanded gaseous air 563 is fed into the low-pressure column 12.

Figure 6:
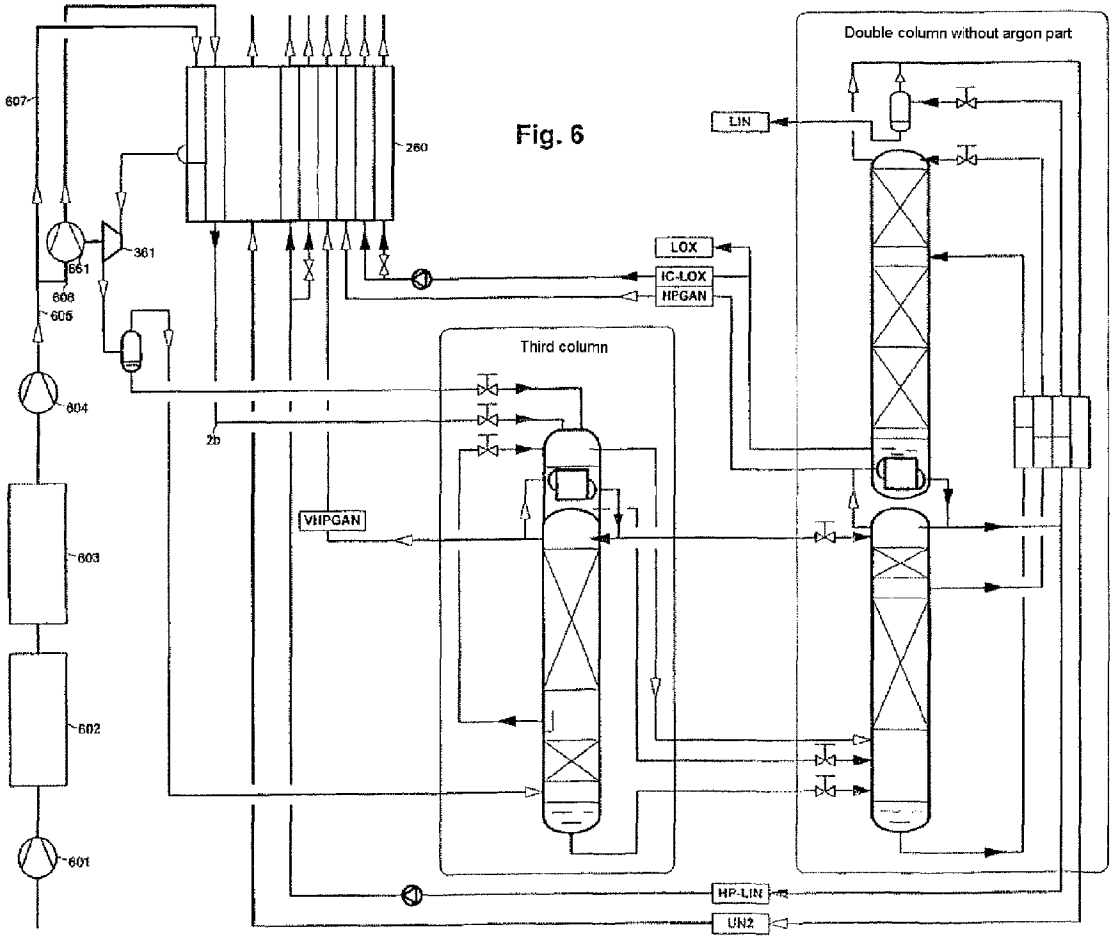

In FIG. 6, a variant of the method according to the invention is shown which is suitable, in particular, for producing impure oxygen. Here the total air is compressed to significantly above precolumn pressure. Otherwise this variant substantially corresponds to that of FIG. 3; an argon production stage, however, is generally not expedient here.

The feed air is here brought in a main air compressor 601 to a pressure of, for example, 5.5 to 24 bar, fed at this pressure to a precooler 602 and further to prepurification 603 which is constructed, for example, as a molecular sieve adsorber station. The total purified feed air is subsequently further compressed in a recompressor 604 to a pressure of, for example, up to 40 bar. The resultant high-pressure air 605 is divided into a first branch stream 606 and a second branch stream 607.

The first branch stream 606 is brought in a further recompressor 661 which is driven by the PC Claude turbine 361 to a still higher pressure and serves as throttle stream 2*b*. The second branch stream 607 is introduced into the main heat exchanger 260 at the exit pressure of the recompressor 604 and expanded in the PC Claude turbine 361.

All of the processes and plants shown are to be understood as exemplary. The drawings are intended primarily to illustrate the functional relationships. Although high-pressure column and low-pressure column are shown one above the other and with an integrated main condenser, in the context of the invention, however, any other known arrangement of columns and condensers is also possible.

The columns can be equipped with sieve trays, structured packings or non-structured packings or else contain combinations of said types of mass-transfer elements.

The main condenser is constructed as falling film or bath evaporator. In the case of a bath evaporator, it can be constructed as a single storey or multistorey (cascade condenser). The top condenser of the precolumn is preferably constructed as a bath condenser.

Some streams or column sections can be absent in the actual connection. In terms of the process this means that the amount of the corresponding stream is equal to zero or the number of theoretical plates in the relevant section is equal to zero. With respect to the device this generally means that the corresponding line or the corresponding column section is absent.

The main heat exchanger can in each case be constructed in an integrated or split manner, the drawings show only the unit function of the exchanger—warm streams are cooled by cold streams.

In all exemplary embodiments of the invention no pump is used to transport a liquid from one column to another column.

The invention claimed is:

1. A method for the low-temperature separation of air in a distillation column system which comprises at least one high-pressure column and one low-pressure column, said method comprising:

feed air is introduced into the distillation column system, wherein a first part of the feed air is introduced in the gaseous state into the distillation column system and a second part of the feed air is introduced in the liquid state into the distillation column system and the second part comprises at least 30 mol % of the total feed air amount, wherein:

the distillation column system in addition comprises a precolumn, the operating pressure of which is higher than the operating pressure of the high-pressure column, a first substream of the feed air is introduced into the precolumn, the precolumn comprises a top condenser which is constructed as a condenser-evaporator having a condensation compartment and an evaporation compartment, a gaseous fraction from the upper region of the precolumn is introduced into the condensation compartment of the top condenser, liquid formed in the condensation compartment is applied at least in part as reflux to the precolumn, and a second substream of the feed air is introduced at least in part in the liquid state into the evaporation compartment of the top condenser.

2. The method as claimed in claim 1, in which the liquid fraction of the second substream during the introduction of the feed air into the evaporation compartment of the top condenser comprises more than 30 mol % of the total feed air amount.

3. The method as claimed in claim 1 wherein the second part of the feed air comprises more than 35 mol % of the feed air amount.

4. The method as claimed in claim 1, wherein at least one end product stream is taken off in the liquid state from the distillation column system and produced as a liquid product.

5. The method as claimed in claim 1, wherein at least one liquid product stream is taken off from the distillation column system, brought in the liquid state to an elevated pressure and at this elevated pressure is vaporized or pseudo-vaporized by indirect heat exchange and finally is withdrawn as a gaseous product stream.

6. The method as claimed in claim 1, wherein the entire feed air is compressed in one or more air compressors to a first pressure which is at least 1 bar above the operating pressure of the high-pressure column.

7. The method as claimed in claim 1, wherein at least a part of the vaporized fraction formed in the vaporization compartment of the top condenser is introduced into the distillation column system downstream of the vaporization compartment of the top condenser of the precolumn.

8. The method as claimed in claim 1, wherein at least a part of the liquid formed in the condensation compartment of the top condenser of the precolumn is fed into the high-pressure column and/or the low-pressure column.

9. The method as claimed in claim 1, wherein a nitrogen product having a nitrogen content of at least 99 mol % is generated in the low-pressure column.

10. The method as claimed in claim 1, wherein an argon-containing stream from the low-pressure column is introduced into an argon part which comprises at least one crude argon column and an argon product is taken off from the argon part.

11. The method as claimed in claim 1, wherein the second substream of the feed air, during the introduction into the vaporization compartment of the top condenser, comprises a liquid fraction of 80 to 100%.

12. A device for low-temperature separation of air, comprising:

a distillation column system which comprises at least one high-pressure column and one low-pressure column and a precolumn, the operating pressure of which during operation of the device is higher than the operating pressure of the high-pressure column, control means, means for introducing feed air into the distillation column system, means for introducing a first substream of the feed air into the precolumn, wherein the precolumn comprises a top condenser which is constructed as a condenser-evaporator having a condensation compartment and an evaporation compartment, means for introducing a gaseous fraction from the upper region of the precolumn into the condensation compartment of the top condenser, means for feeding in liquid formed in the condensation compartment as reflux into the precolumn, and means for introducing a second substream of the feed air at least in part in the liquid state into the evaporation compartment of the top condenser, wherein the control means are constructed in such a manner that, on operation of the device, at least 30 mol % of the total feed air amount is introduced in the liquid state into the distillation column system.

13. The device as claimed in claim 12, wherein the control means are constructed in such a manner that, on operation of the device, the liquid fraction of the second substream of the feed air during the introduction into the evaporation compartment of the top condenser comprises more than 30 mol % of the total feed air amount.

14. The method as claimed in claim 1, in which the liquid fraction of the second substream during the introduction of the feed air into the evaporation compartment of the top condenser comprises more than 35 mol % of the total feed air amount.

15. The method as claimed in claim 1, in which the liquid fraction of the second substream during the introduction of the feed air into the evaporation compartment of the top condenser comprises more than 40 mol % of the total feed air amount.

16. The method as claimed in claim 1, wherein the second part of the feed air comprises more than 40 mol % of the feed air amount.

17. The method as claimed in claim 1, wherein at least a part of the vaporized fraction formed in the vaporization compartment of the top condenser is introduced into the high-pressure column downstream of the vaporization compartment of the top condenser of the precolumn.

18. The method as claimed in claim 1, wherein the second substream of the feed air, during the introduction into the vaporization compartment of the top condenser, comprises a liquid fraction of 85 to 95 mol %.

* * * * *